US012055322B2

(12) United States Patent
Okamoto et al.

(10) Patent No.: US 12,055,322 B2
(45) Date of Patent: Aug. 6, 2024

(54) COMPRESSOR AND REFRIGERATION CYCLE DEVICE APPARATUS

(71) Applicant: DAIKIN INDUSTRIES, LTD., Osaka (JP)

(72) Inventors: Masakazu Okamoto, Osaka (JP); Yasuhiro Kouno, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 953 days.

(21) Appl. No.: 17/043,543

(22) PCT Filed: Mar. 27, 2019

(86) PCT No.: PCT/JP2019/013102
§ 371 (c)(1),
(2) Date: Sep. 29, 2020

(87) PCT Pub. No.: WO2019/189315
PCT Pub. Date: Oct. 3, 2019

(65) Prior Publication Data

US 2021/0033311 A1 Feb. 4, 2021

(30) Foreign Application Priority Data

Mar. 30, 2018 (JP) ..... 2018-070184

(51) Int. Cl.
*F25B 1/04* (2006.01)
*F04C 18/02* (2006.01)
*F04C 28/28* (2006.01)

(52) U.S. Cl.
CPC ..... *F25B 1/04* (2013.01); *F04C 18/0215* (2013.01); *F04C 28/28* (2013.01);
(Continued)

(58) Field of Classification Search
CPC ..... F25B 1/04; F04C 18/0215; F04C 28/28; F04C 2240/806; F04C 2240/81; F04C 2270/19
See application file for complete search history.

(56) References Cited

U.S. PATENT DOCUMENTS 5,509,786 A 4/1996 Mizutani et al.
6,615,598 B1 9/2003 Wang et al.
(Continued)

FOREIGN PATENT DOCUMENTS

CN 1715657 A 1/2006
CN 102720672 A 10/2012
(Continued)

OTHER PUBLICATIONS

JPH06159270A mt (Year: 1994).*
(Continued)

*Primary Examiner* — Gordon A Jones
(74) *Attorney, Agent, or Firm* — Global IP Counselors, LLP

(57) ABSTRACT

A compressor includes a casing, compression mechanism disposed inside the casing, a discharge tube, a first temperature sensor, and a second temperature sensor. The compression mechanism compresses a sucked refrigerant, and discharges the compressed refrigerant to a refrigerant channel formed in an inner space of the casing. The compressed refrigerant flows from the inner space of the casing to an outside through the discharge tube. The first temperature sensor includes a temperature sensing portion disposed in the refrigerant channel, and directly measuring a temperature of the refrigerant. The second temperature sensor is disposed at a different position from the first temperature sensor. The second temperature sensor measures a tempera-
(Continued)

ture of one of a surface of the discharge tube, an inner space of the discharge tube, and a surface of the casing.

20 Claims, 8 Drawing Sheets

(52) U.S. Cl.
CPC .... *F04C 2240/806* (2013.01); *F04C 2240/81* (2013.01); *F04C 2270/19* (2013.01)

(56) References Cited

U.S. PATENT DOCUMENTS

| | | | | |
|---|---|---|---|---|
| 2004/0115063 | A1 | 6/2004 | Hong et al. | |
| 2006/0247827 | A1 | 11/2006 | Fukasaku et al. | |
| 2006/0275143 | A1 | 12/2006 | Jayanth | |
| 2009/0095002 | A1 | 4/2009 | McSweeney et al. | |
| 2010/0132389 | A1 | 6/2010 | Nishide et al. | |
| 2011/0058971 | A1* | 3/2011 | Hahn | F04C 18/0215 62/199 |
| 2012/0294733 | A1* | 11/2012 | Yamada | F04C 29/028 417/63 |
| 2014/0044562 | A1* | 2/2014 | Lee | F04C 29/04 417/32 |
| 2016/0018148 | A1 | 1/2016 | Yura | |
| 2016/0123325 | A1* | 5/2016 | Kim | F04C 18/0223 73/53.01 |
| 2017/0045052 | A1* | 2/2017 | Brostrom | F04C 23/001 |

FOREIGN PATENT DOCUMENTS

| | | | |
|---|---|---|---|
| DE | 10 2011 083 373 | A1 | 3/2012 |
| EP | 0 608 073 | A1 | 7/1994 |
| EP | 2 966 380 | A1 | 1/2016 |
| EP | 3 346 134 | A1 | 7/2018 |
| JP | 61-197272 | U | 12/1986 |
| JP | 2-241998 | A | 9/1990 |
| JP | 5-312167 | A | 11/1993 |
| JP | 6-17780 | A | 1/1994 |
| JP | 6-159270 | A | 6/1994 |
| JP | 7-324988 | A | 12/1995 |
| JP | 2003-83258 | A | 3/2003 |
| JP | 2006-126067 | A | 5/2006 |
| JP | 2006-307720 | A | 11/2006 |
| JP | 2008-298065 | A | 12/2008 |
| JP | 2012-93340 | A | 5/2012 |
| JP | 2014-173791 | A | 9/2014 |
| WO | 2008/030572 | A1 | 3/2008 |
| WO | 2017/061167 | A1 | 4/2017 |

OTHER PUBLICATIONS

International Preliminary Report of corresponding PCT Application No. PCT/JP2019/013102 dated Oct. 15, 2020.
International Search Report of corresponding PCT Application No. PCT/JP2019/013102 dated Jul. 2, 2019.
European Search Report of corresponding EP Application No. 19 77 8328.5 dated Nov. 2, 2021.
European Search Report of corresponding EP Application No. 22 19 2537.3 dated Dec. 12, 2022.

* cited by examiner

COMPRESSOR AND REFRIGERATION CYCLE DEVICE APPARATUS

CROSS-REFERENCE TO RELATED APPLICATIONS

This U.S. National stage application claims priority under 35 U.S.C. § 119(a) to Japanese Patent Application No. 2018-070184, filed in Japan on Mar. 30, 2018, the entire contents of which are hereby incorporated herein by reference.

BACKGROUND

Field of the Invention

The present disclosure relates to a compressor and a refrigeration cycle apparatus.

Background Information

To prevent over compression and abnormally high temperature of a compressor body, the temperature of a gas discharged from the compressor is measured. JP-2-241998 discloses a discharge temperature switch in which a temperature probe of the discharge temperature switch is disposed at a position downstream of the compressor body where pulsation of the compressor body is sufficiently attenuated.

SUMMARY

However, according to the technique of JP-2-241998 described above, the response of the temperature measurement is sometimes delayed because the temperature of the discharged gas is not measured immediately after being compressed. As a result of this, the reliability of the compressor can be decreased.

A compressor of a first aspect includes a casing, a compression mechanism, a discharge tube, a first temperature sensor, and a second temperature sensor. The compression mechanism is disposed inside the casing, compresses a sucked refrigerant, and discharges the compressed refrigerant to a refrigerant channel formed in an inner space of the casing. In the discharge tube, the compressed refrigerant flows from the inner space of the casing to the outside. The first temperature sensor includes a temperature sensing portion. The temperature sensing portion is disposed in the refrigerant channel. The temperature sensing portion directly measures the temperature of the refrigerant. "Directly measure" means directly measuring the temperature of the refrigerant instead of measuring the temperature of a pipe in which the refrigerant flows or a part that receives heat transmission from the refrigerant. The second temperature sensor is disposed at a different position from the first temperature sensor and measures the temperature of one of the surface of the discharge tube, an inner space of the discharge tube, and the surface of the casing. According to such a configuration, a temperature reflecting an influence of the heat capacity and heat dissipation of constituent members of the compressor can be measured, and a compressor of high reliability can be disposed.

A compressor of a second aspect is the compressor of the first aspect, and the second temperature sensor measures the temperature of the surface of the discharge tube. According to such a configuration, the temperature of the compressor can be measured with higher accuracy.

A compressor of a third aspect is the compressor of the first aspect or the second aspect, and the first temperature sensor is disposed to penetrate the casing. In addition, the first temperature sensor is detachably attached to the casing from the outside. According to such a configuration, maintenance can be performed easily.

A compressor of a fourth aspect is the compressor of any one of the first aspect to the third aspect, and the temperature sensing portion of the first temperature sensor is thermally insulated from the casing. According to such a configuration, the temperature of the refrigerant can be measured with high accuracy.

A compressor of a fifth aspect is the compressor of any one of the first aspect to the fourth aspect, and further includes a guide plate that is disposed inside the casing and reduces a channel cross-sectional area of the refrigerant channel. In addition, the first temperature sensor measures the temperature of a space defined by the guide plate. According to such a configuration, the temperature of the refrigerant of high flow rate is measured, and therefore the responsiveness can be improved.

A compressor of a sixth aspect is the compressor of the fifth aspect, and further includes a motor that is disposed below the compression mechanism inside the casing and drives the compression mechanism. The motor is disposed to form a refrigerant channel in part of a space between the outer periphery of the motor and the inner wall of the casing. In addition, the guide plate is disposed so as to guide the refrigerant to the refrigerant channel between the outer periphery of the motor and the inner wall of the casing. According to such a configuration, reduction of size and cost of the apparatus can be realized.

A compressor of a seventh aspect is the compressor of the fifth aspect or the sixth aspect, and, in a region near the inner wall of the casing, the discharge tube is disposed on the opposite side to a region defined by the guide plate in plan view. According to such a configuration, the second temperature sensor can measure a temperature reflecting information not influenced by the first temperature sensor.

A compressor of an eighth aspect is the compressor of any one of the first aspect to the seventh aspect, and the second temperature sensor is disposed within a range where a channel length from the casing is 1 m or less. According to such a configuration, influence of heat transfer loss and heat capacity can be suppressed.

A refrigeration cycle apparatus of a ninth aspect includes a refrigeration cycle in which the refrigerant flows in the order of the compressor of any one of the first aspect to the eighth aspect, a condenser, an expansion mechanism, and an evaporator. In addition, the refrigeration cycle apparatus further includes a calculation unit that calculates the temperature of a refrigerant discharged from the compression mechanism, by using the first temperature sensor and the second temperature sensor. According to such a configuration, a refrigeration cycle apparatus in which the refrigerant temperature immediately after a discharge port of the compression mechanism can be estimated with high accuracy can be disposed.

A refrigeration cycle apparatus of a tenth aspect is the refrigeration cycle apparatus of the ninth aspect, and the compressor includes a motor that is disposed below the compression mechanism inside the casing and drives the compression mechanism. In addition, the refrigeration cycle apparatus further includes a rotation number control unit that controls the number of rotations of the motor on the basis of the temperature of refrigerant calculated by the calculation unit. According to such a configuration, a compressor of high reliability can be disposed.

A refrigeration cycle apparatus of an eleventh aspect is the refrigeration cycle apparatus of the ninth aspect or the tenth aspect, and further includes an injection pipe, a flow rate adjustment mechanism, and an opening degree control unit. The injection pipe is branched from part of a pipe extending from the condenser to the expansion mechanism and connects to the compressor. The flow rate adjustment mechanism adjusts the flow rate of the refrigerant in the injection pipe. The opening degree control unit controls the opening degree of the flow rate adjustment mechanism on the basis of the temperature of refrigerant calculated by the calculation unit. According to such a configuration, a refrigeration cycle apparatus of high reliability can be disposed.

A refrigeration cycle apparatus of a twelfth aspect is the refrigeration cycle apparatus of the eleventh aspect, and further includes a gasification mechanism that gasifies a liquid refrigerant flowing in the injection pipe. According to such a configuration, control can be performed with higher accuracy such that the discharge temperature reaches a target value. To be noted, the "gasification" used herein can be used as long as at least part of the liquid refrigerant is gasified, and does not necessarily mean gasifying all of the liquid refrigerant.

DETAILED DESCRIPTION OF EMBODIMENT(S)

(1) Configuration of Scroll Compressor

Figure 1:
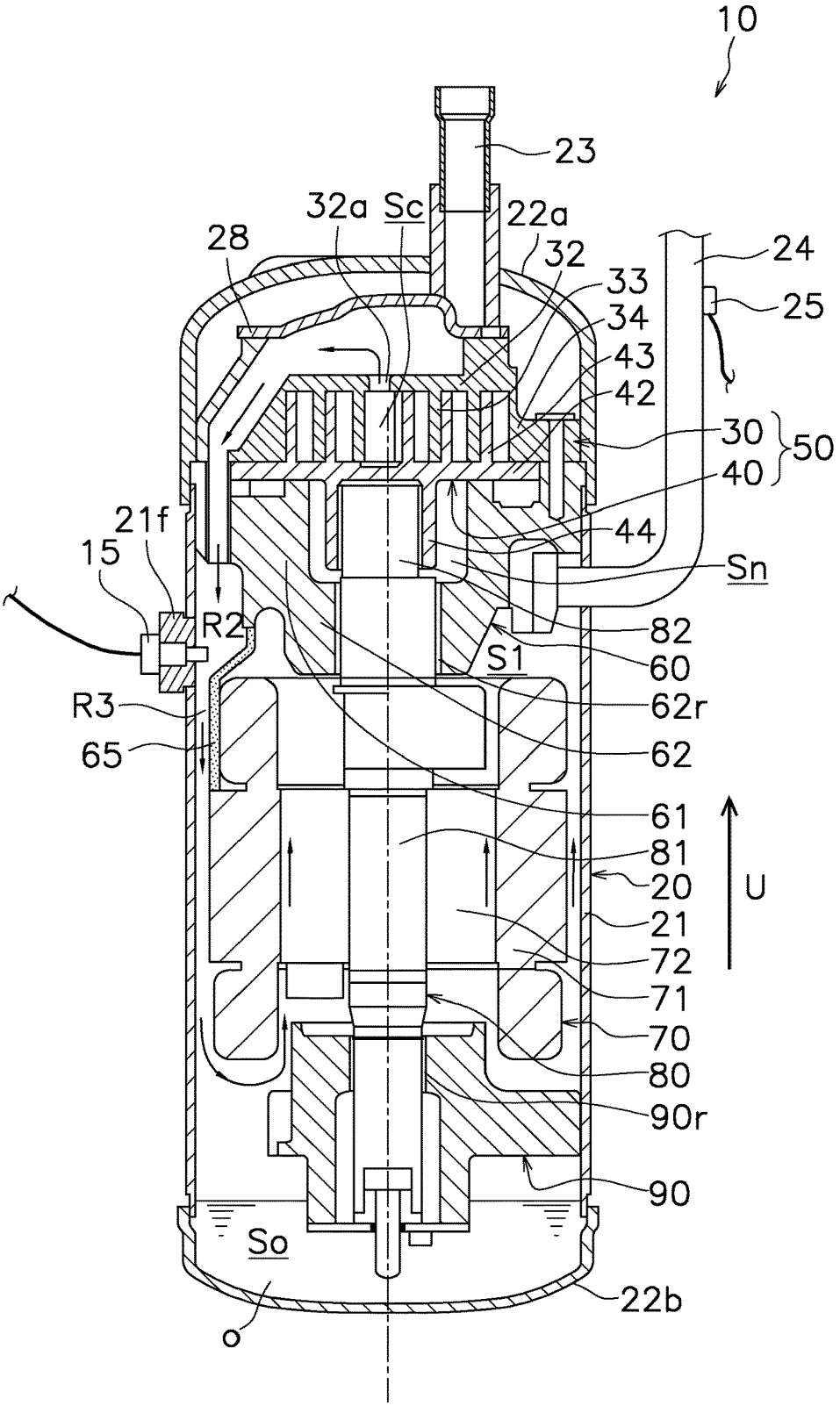
FIG. 1 is a schematic diagram for describing a configuration of a longitudinal section of a scroll compressor 10 according to an embodiment.
Figure 2:
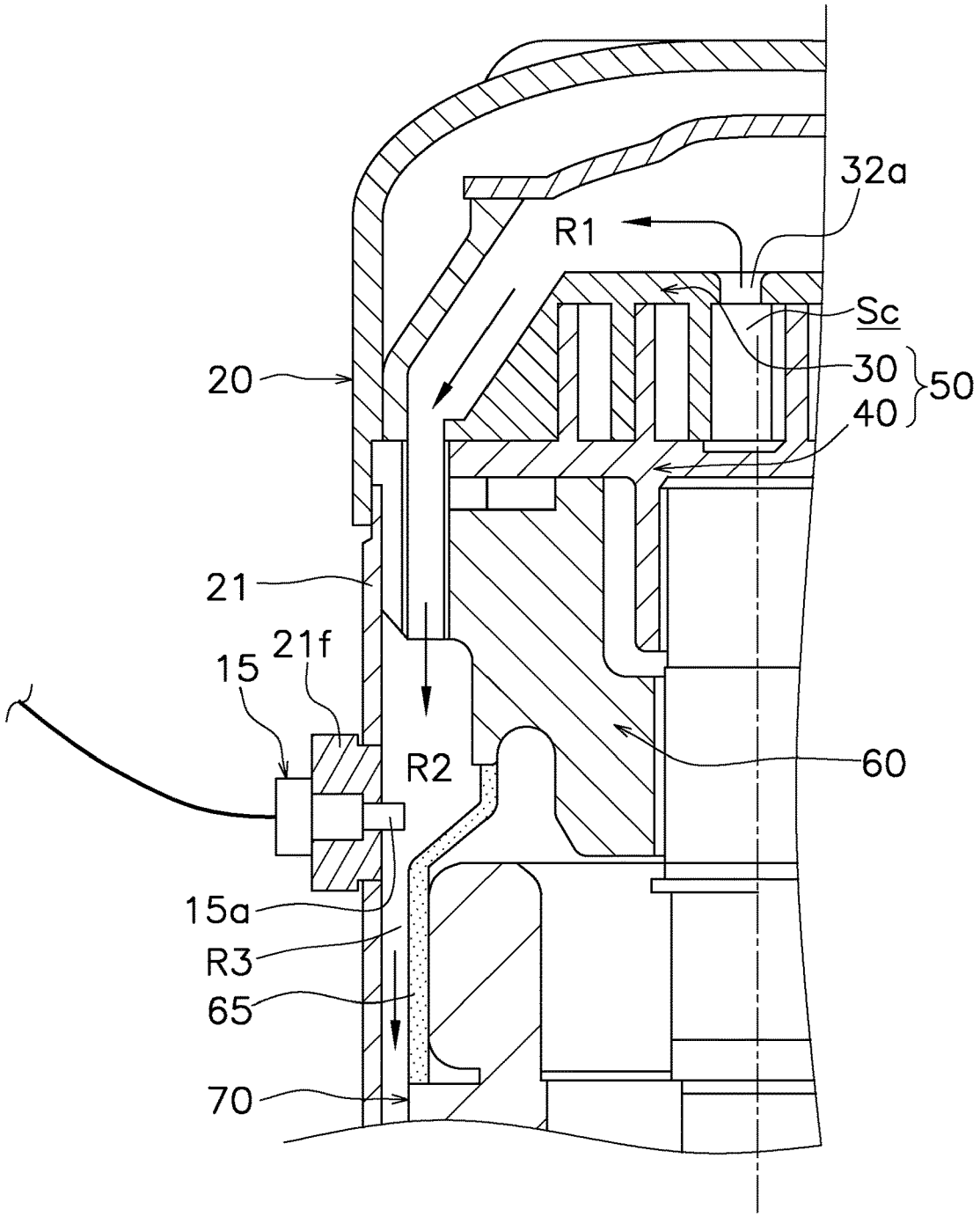
FIG. 2 is a schematic diagram for describing the configuration of the longitudinal section of the scroll compressor 10 according to the embodiment (enlarged view of a part of FIG. 1).

FIG. 1 is a schematic diagram for describing a configuration of a longitudinal section of a scroll compressor 10 according to an embodiment. FIG. 2 is an enlarged view of a part of FIG. 1. To be noted, FIGS. 1 and 2 are not precise sectional views, and are sectional views as viewed in different directions, that is, sectional views of right side and left side as viewed from the center. In addition, some parts of constituent members are appropriately omitted.

As illustrated in FIG. 1, the scroll compressor 10 includes a casing 20, a partitioning member 28, a scroll compression mechanism 50 including a fixed scroll 30 and a movable scroll 40, a housing 60, a driving motor 70, a crank shaft 80, and a lower bearing portion 90.

In the description below, expressions such as "upward" and "downward" may be used for describing positional relationships and the like of constituent members. Here, the direction of an arrow U in FIG. 1 will be referred to as an upward direction, and a direction opposite to the arrow U will be referred to as a downward direction. In addition, in the description below, expressions such as "vertical", "horizontal", "longitudinal", and "lateral" may be used, and an up-down direction will be referred to as a vertical direction and also a longitudinal direction.

(1-1) Casing

The scroll compressor 10 includes the casing 20 of a sealed dome type having an elongated cylindrical shape. The casing 20 includes a body portion 21 having an approximately cylindrical shape opening on the upper side and the lower side, and an upper lid 22*a* and a lower lid 22*b* respectively disposed at the upper end and lower end of the body portion 21. The body portion 21, the upper lid 22*a*, and the lower lid 22*b* are fixed to each other by welding so as to keep airtightness.

The casing 20 accommodates constituent devices of the scroll compressor 10 including the scroll compression mechanism 50, the driving motor 70, the crank shaft 80, and the lower bearing portion 90. The scroll compression mechanism 50 is disposed in an upper portion in the body portion 21. In addition, an oil reservoir space So is defined in a lower portion of the casing 20. A refrigerating machine oil O for lubricating the scroll compression mechanism 50 and the like is reserved in the oil reservoir space So.

An inlet tube 23 penetrating through the upper lid 22*a* is provided in an upper portion of the casing 20. A lower end of the inlet tube 23 is connected to an inlet connecting port of the fixed scroll 30. As a result of this, the inlet tube 23 communicates with a compression chamber Sc of the scroll compression mechanism 50 that will be described later. A low-pressure refrigerant of a refrigeration cycle before being compressed by the scroll compressor 10 flows into the inlet tube 23. Then, a gas refrigerant is supplied to the scroll compression mechanism 50 through the inlet tube 23.

A discharge tube 24 through which a refrigerant to be discharged to the outside of the casing 20 passes is provided in the body portion 21 of the casing 20. A high-pressure gas refrigerant compressed by the scroll compression mechanism 50 flows out from an inner space of the casing 20 to the outside through the discharge tube 24.

To be noted, as the refrigerant of the scroll compressor 10, for example, R32 can be used.

(1-2) Scroll Compression Mechanism

The scroll compression mechanism 50 is disposed inside the casing 20, compresses a sucked refrigerant, and discharges the compressed refrigerant to refrigerant channels (including refrigerant channels R1 to R3) formed in the inner space of the casing 20.

Specifically, as illustrated in FIGS. 1 and 2, the scroll compression mechanism 50 includes the fixed scroll 30 disposed above the housing 60 and the movable scroll 40 that defines the compression chamber Sc in combination with the fixed scroll 30.

(1-2-1) Fixed Scroll

As illustrated in FIGS. 1 and 2, the fixed scroll 30 includes a fixed-side mirror plate 32 having a flat plate shape, a fixed-side lap 33 having a spiral shape and projecting from a front surface of the fixed-side mirror plate 32, and an outer edge portion 34 surrounding the fixed-side lap 33. The fixed-side lap 33 is formed to extend in a spiral shape from a discharge port 32*a* that will be described later to the outer edge portion 34. In addition, an inlet port is provided in the outer edge portion 34 of the fixed scroll 30. A refrigerant flowing in through the inlet tube 23 is introduced, through this inlet port, into the compression chamber Sc of the scroll compression mechanism 50. To be noted, a check valve that prevents a backward flow of the refrigerant is provided in the inlet port.

A discharge port 32*a* communicating with the compression chamber Sc of the scroll compression mechanism 50 is formed at a center portion of the fixed-side mirror plate 32 to penetrate the fixed-side mirror plate 32 in a thickness direction. The refrigerant compressed in the compression chamber Sc is discharged through the discharge port 32*a*, and flows into a high-pressure space S1 through a first refrigerant channel R1 formed in the fixed scroll 30 and the housing 60.

(1-2-2) Movable Scroll

As illustrated in FIGS. 1 and 2, the movable scroll 40 includes a movable-side mirror plate 42 having a flat plate shape, a movable-side lap 43 having a spiral shape and projecting from a front surface of the movable-side mirror plate 42, and a boss portion 44 having a cylindrical shape and projecting from a back surface of the movable-side mirror plate 42.

Here, the fixed-side lap 33 of the fixed scroll 30 and the movable-side lap 43 of the movable scroll 40 are combined such that a lower surface of the fixed-side mirror plate 32 and an upper surface of the movable-side mirror plate 42 oppose each other. As a result of this, the compression chamber Sc is formed between the fixed-side lap 33 and the movable-side lap 43 that are adjacent to each other. Then, as a result of the movable scroll 40 revolving around the fixed scroll 30, the volume of the compression chamber Sc periodically changes. As a result of this, the refrigerant sucked in through the inlet tube 23 is compressed in the compression chamber Sc.

The boss portion 44 has a cylindrical shape whose upper end is closed. An eccentric portion 82 of the crank shaft 80 is inserted in a hollow portion of the boss portion 44. As a result of this, the movable scroll 40 and the crank shaft 80 are coupled to each other. The boss portion 44 is disposed in an eccentric portion space Sn defined between the movable scroll 40 and the housing 60. The eccentric portion space Sn communicates with the high-pressure space S1 through an oil supply path in the crank shaft 80 or the like, and a high pressure is applied to the eccentric portion space Sn. As a result of this pressure, a lower surface of the movable-side mirror plate 42 in the eccentric portion space Sn is pushed upward toward the fixed scroll 30. As a result of this, the movable scroll 40 comes into firm contact with the fixed scroll 30.

To be noted, the movable scroll 40 is supported by the housing 60 via an oldham ring. An oldham ring is a member that prevents rotation of the movable scroll 40 and causes the movable scroll 40 to revolve.

(1-3) Housing

The housing 60 is press-fitted in the body portion 21, and an outer peripheral surface thereof is entirely fixed to the body portion 21 in the peripheral direction. In addition, the housing 60 and the fixed scroll 30 are fixed to each other with bolts or the like such that an upper end surface of the housing 60 is in firm contact with a lower surface of the outer edge portion 34 of the fixed scroll 30.

In the housing 60, a concave portion 61 recessed in a center portion of the upper surface and a bearing portion 62 disposed below the concave portion 61 are formed.

The concave portion 61 surrounds the side surface of the eccentric portion space Sn where the boss portion 44 of the movable scroll 40 is disposed.

In the bearing portion 62, a bearing 62*r* that rotatably supports a main shaft 81 of the crank shaft 80 is disposed. The bearing 62*r* rotatably supports the main shaft 81 inserted in the bearing 62*r*.

(1-4) Driving Motor

The driving motor 70 includes a ring-shaped stator 71 fixed to an inner wall surface of the body portion 21, and a rotor 72 rotatably accommodated inside the stator 71 with a gap (air gap path) therebetween.

The rotor 72 is coupled to the movable scroll 40 via the crank shaft 80 disposed to extend in the up-down direction along the axial center of the body portion 21. The rotor 72 rotates, and thus the movable scroll 40 revolves around the fixed scroll 30.

In addition, the driving motor 70 is disposed to form a refrigerant channel R3 in part of a space between the outer periphery of the driving motor 70 and the inner wall of the casing 20. Details of the refrigerant channel R3 will be described later.

(1-5) Crank Shaft

The crank shaft 80 (drive shaft) is disposed inside the body portion 21, and drives the scroll compression mechanism 50. Specifically, the crank shaft 80 transmits a driving force of the driving motor 70 to the movable scroll 40. The crank shaft 80 is disposed to extend in the up-down direction along the axial center of the body portion 21, and couples the rotor 72 of the driving motor 70 and the movable scroll 40 of the scroll compression mechanism 50 to each other.

The crank shaft 80 includes the main shaft 81 whose center axis coincides with the axial center of the body portion 21, and the eccentric portion 82 eccentric with respect to the axial center of the body portion 21. The main shaft 81 is rotatably supported by the bearing 62*r* of the bearing portion 62 of the housing 60 and a bearing 90*r* of the lower bearing portion 90. The eccentric portion 82 is inserted in the boss portion 44 of the movable scroll 40 as described above.

Inside the crank shaft 80, an oil supply path is formed for supplying the refrigerating machine oil O to the scroll compression mechanism 50 and the like. The lower end of the main shaft 81 is positioned in the oil reservoir space So formed in a lower portion of the casing 20, and the refrigerating machine oil O in the oil reservoir space So is supplied to the scroll compression mechanism 50 and the like through the oil supply path.

(1-6) Lower Bearing Portion

The lower bearing portion 90 is provided in a lower portion of the body portion 21, and rotatably supports the crank shaft 80. Specifically, the lower bearing portion 90 includes the bearing 90*r* on the lower end side of the crank shaft 80. As a result of this, the main shaft 81 of the crank shaft 80 is rotatably supported. To be noted, an oil pickup communicating with the oil supply path of the crank shaft 80 is fixed to the lower bearing portion 90.

(2) Operation of Scroll Compressor

Next, the operation of the scroll compressor 10 described above will be described.

First, the driving motor 70 is activated. As a result of this, the rotor 72 rotates with respect to the stator 71, and the crank shaft 80 fixed to the rotor 72 rotates. When the crank shaft 80 rotates, the movable scroll 40 coupled to the crank shaft 80 revolves around the fixed scroll 30. Then, the low-pressure gas refrigerant of the refrigeration cycle is sucked into the compression chamber Sc through the inlet tube 23 from the peripheral side of the compression chamber Sc. As the movable scroll 40 revolves, the inlet tube 23 and the compression chamber Sc cease to communicate with each other. Then, as the capacity of the compression chamber Sc decreases, the pressure in the compression chamber Sc starts increasing.

The refrigerant in the compression chamber Sc is compressed as the capacity of the compression chamber Sc decreases, and eventually becomes a high-pressure gas refrigerant. The high-pressure gas refrigerant is discharged through the discharge port 32*a* positioned near the center of the fixed-side mirror plate 32. Then, the high-pressure gas refrigerant flows into the high-pressure space S1 through the refrigerant channel R1 formed in the fixed scroll 30 and the housing 60, and is discharged through the discharge tube 24.

(3) Measurement of Refrigerant Temperature

Next, a configuration for measuring the temperature of the refrigerant in the scroll compressor 10 described above will be described.

(3-1) Configuration of Temperature Sensor

The scroll compressor 10 includes a first temperature sensor 15 and a second temperature sensor 25 for measuring the temperature of the refrigerant compressed by the scroll compression mechanism 50.

Figure 3:
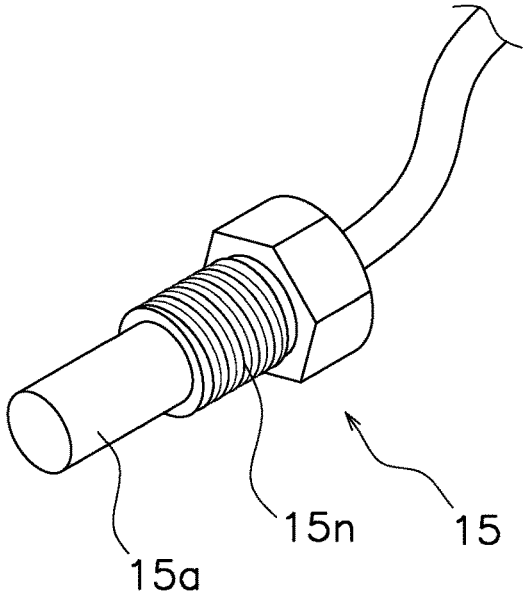
FIG. 3 is a schematic diagram illustrating a configuration of a first temperature sensor 15 according to the embodiment.

As illustrated in FIG. 3, the first temperature sensor 15 includes a temperature sensing portion 15*a* and a screw-shaped portion 15*n*. The temperature sensing portion 15*a* includes a thermistor that measures the temperature, and a metal cover that protects the thermistor. The metal is, for example, copper. As illustrated in FIG. 2, the metal cover of the temperature sensing portion 15*a* is disposed to be in contact with the refrigerant flowing in the second refrigerant channel R2. In other words, the temperature sensing portion 15*a* is disposed so as to directly measure the temperature of the refrigerant. Here, the second refrigerant channel R2 is a space continuous from the first refrigerant channel R1 formed in the housing 60. In addition, "directly measure" means directly measuring the temperature of the refrigerant instead of measuring the temperature of a pipe in which the refrigerant flows or a part that receives heat transmission from the refrigerant.

The first temperature sensor 15 is disposed to penetrate the casing 20. The first temperature sensor 15 can be fixed and disposed by being screwed to a screw-in joint 21*f* provided to the body portion 21 of the casing 20 and by being sealed. In addition, since the first temperature sensor 15 is screwed at the screw-shaped portion 15*n*, the first temperature sensor 15 can be easily attached from the outside of the casing 20. In addition, the temperature sensing portion 15*a* of the first temperature sensor 15 is thermally insulated from the casing 20. The first temperature sensor 15 is disposed at a position near an outlet port of the refrigerant channel R1 of the housing 60. To be noted, the temperature sensing portion 15*a* is formed from copper or the like having high thermal conductivity. In addition, the joint 21*f* is formed from iron or the like having low thermal conductivity.

The second temperature sensor 25 is disposed at a different position from the first temperature sensor 15. Here, as illustrated in FIG. 1, the second temperature sensor 25 is disposed on the surface of the discharge tube 24, and measures the temperature of the surface of the discharge tube 24. In addition, the second temperature sensor 25 is disposed within a range where the length of a channel from the casing 20 is 1 m or less. Therefore, the second temperature sensor 25 is disposed on the surface of the discharge tube 24 within a range of 1 m from the body of the compressor 10.

(3-2) Placement of Guide Plate

The scroll compressor 10 includes a guide plate 65 as illustrated in FIGS. 1 and 2. The first temperature sensor 15 described above measures the temperature in a space (second refrigerant channel R2) defined by the guide plate 65.

The guide plate 65 is disposed inside the casing 20, and reduces the channel cross-sectional area of the second refrigerant channel R2. Specifically, the guide plate 65 is disposed to guide the refrigerant to the third refrigerant channel R3, which is a space defined below the housing 60 and defined in part of the space between the outer periphery of the driving motor 70 and the inner wall of the casing 20. In other words, the second refrigerant channel R2 and the third refrigerant channel R3 are continuous from each other via the guide plate 65.

Figure 4:
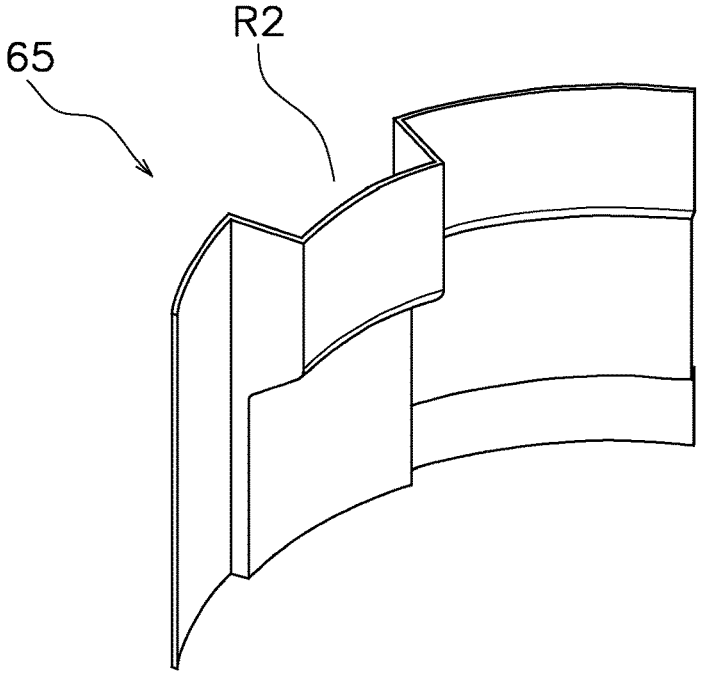
FIG. 4 is a schematic diagram illustrating a configuration of a guide plate 65 according to the embodiment.

To be noted, the guide plate 65 has a shape as illustrated in FIG. 4, and defines the second refrigerant channel R2 such that the second refrigerant channel R2 is concentrated in a part (core cut portion of one pole part of the stator 71) of the space between the outer periphery of the driving motor 70 and the inner wall of the casing 20. Therefore, other core cut portions can be used for oil return or the like.

(3-3) Calculation of Refrigerant Temperature

The scroll compressor 10 is connected to the control apparatus 5 that will be described later. The control apparatus 5 functions as a calculation unit 5*a* that calculates a temperature estimation value HTp of the refrigerant at the discharge port 32*a* on the basis of a measurement value Tp of the first temperature sensor 15 and a measurement value Td of the second temperature sensor 25. Specifically, the control apparatus 5 (calculation unit 5*a*) estimates the temperature of the refrigerant on the basis of the following formula (1). To be noted, K represents a correction coefficient, and is set on the basis of a measured value of the refrigerant temperature at the discharge port 32*a* measured in an experimental environment. In addition, n is a natural number.

[Math. 1]

$$HTp = Tp + K(Tp - Td)^n \quad (1)$$

(3-4) Example of Test of Temperature Estimation

The scroll compressor 10 according to the present embodiment includes the first temperature sensor 15 and the second temperature sensor 25 described above and estimates the refrigerant temperature at the discharge port 32*a*, and this is based on the following findings by the present inventors. In other words, as a result of intensive effort, the present inventors found that the refrigerant temperature at the discharge port 32*a* can be estimated with high accuracy by using the formula (1) described above.

Figure 5:
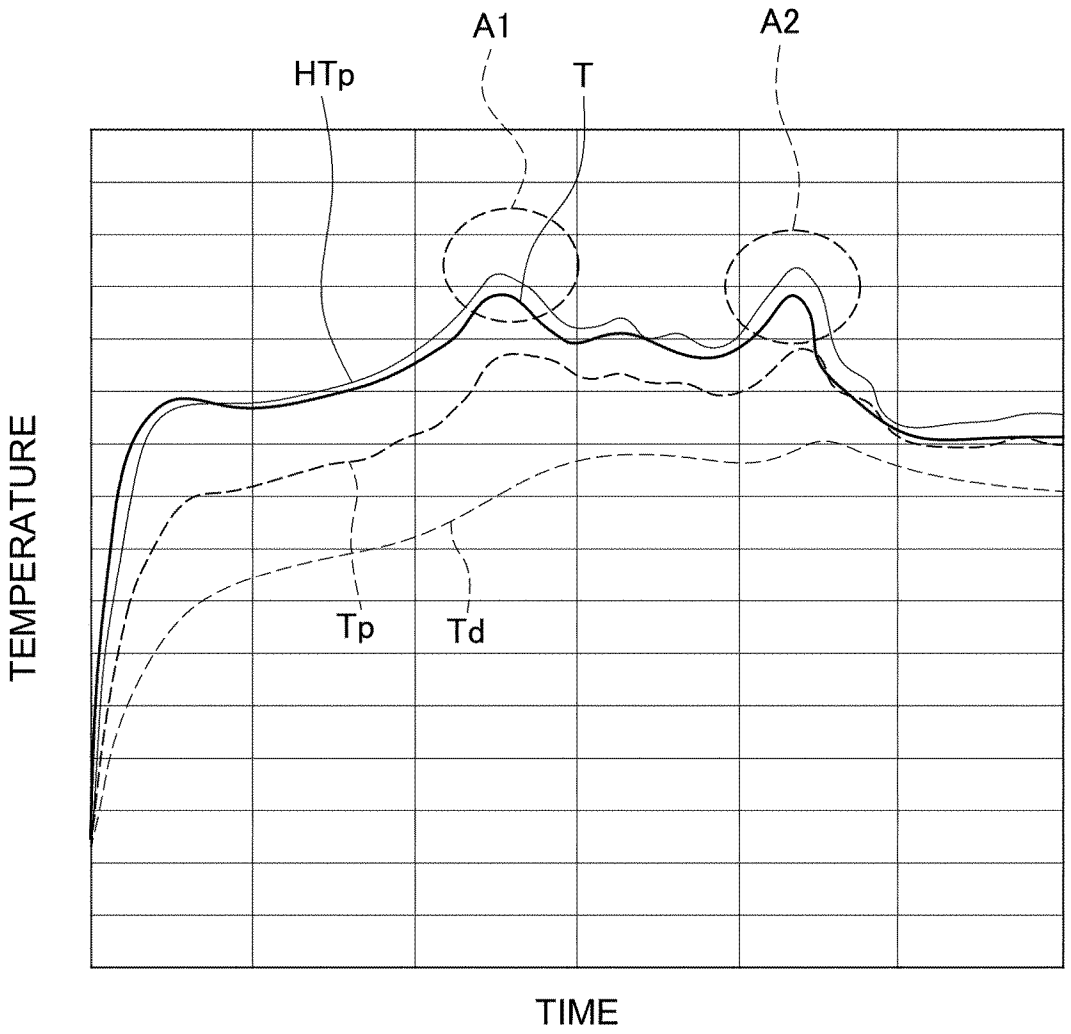
FIG. 5 is a diagram illustrating an example of a test result of temperature estimation.

For example, a result illustrated in FIG. 5 was obtained for the measurement values of the temperature sensors when the scroll compressor 10 was controlled. Here, the measured value of the refrigerant temperature at the discharge port 32*a*, the measurement value of the first temperature sensor 15, and the measurement value of the second temperature sensor 25 are respectively indicated by lines T, Tp, and Td in FIG. 5. In addition, the temperature estimation value calculated by using the formula (1) described above is indicated by a line HTp. To be noted, in FIG. 5, the horizontal axis represents the time, and the vertical axis represents the temperature.

Focusing on dotted parts A1 and A2 in FIG. 5, it can be recognized that the line HTp follows well the line T indicating the measured value, even when sudden temperature change is caused by change in the performance or the like. To be noted, the safety can be improved by configuring such that the error has a positive value when the temperature of the discharge port 32*a*, which needs to be protected, increases.

Figure 6:
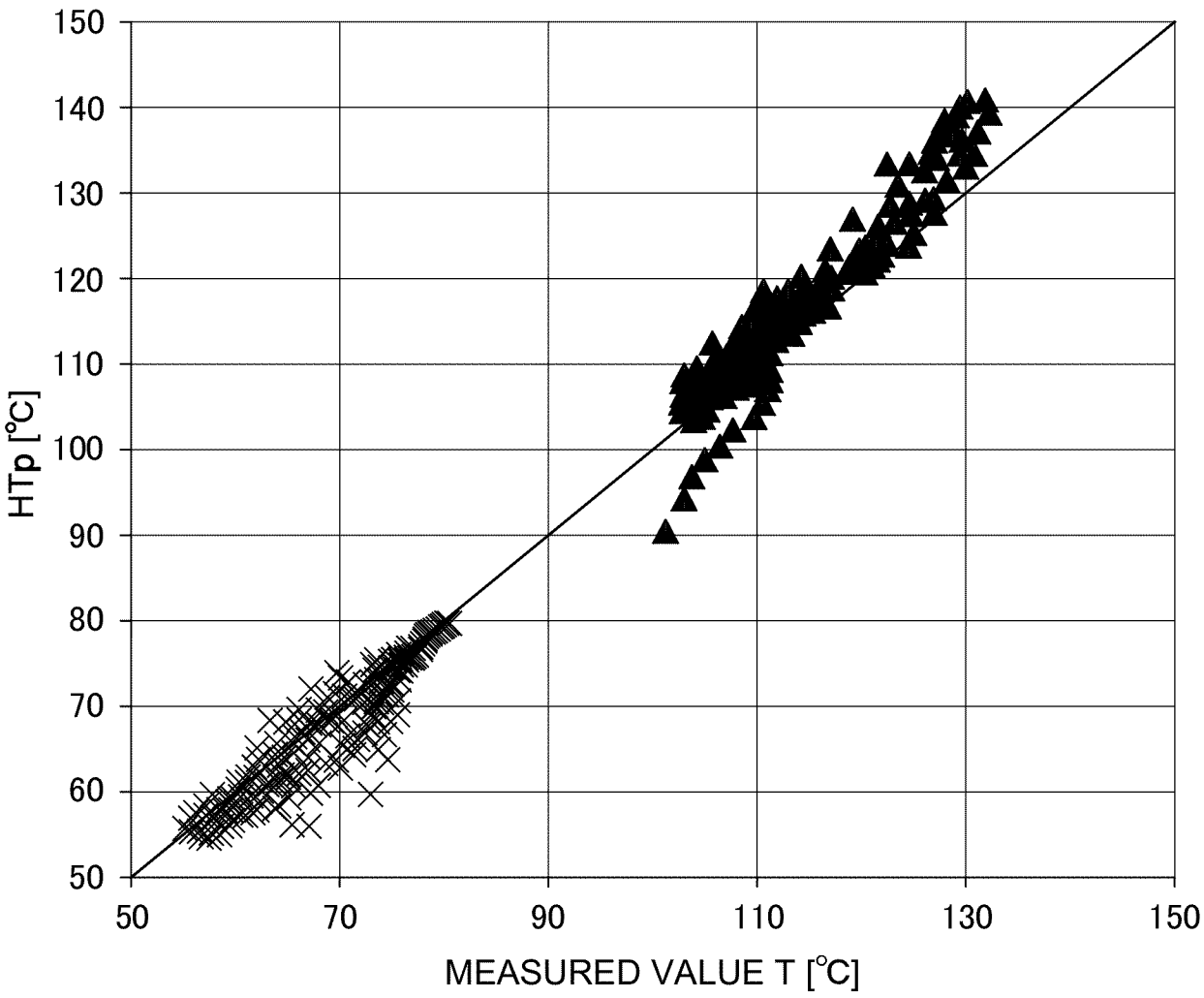
FIG. 6 is a diagram illustrating an example of a test result of temperature estimation.

In addition, a result illustrated in FIG. 6 was obtained when the horizontal axis was set to represent the measured value T of the refrigerant temperature at the discharge port 32*a* and the vertical axis was set to represent the temperature estimation value HTp calculated by using the formula (1) described above. Here, it can be recognized that the estimation accuracy is approximately within ±10° C.

As described above, it was confirmed that the refrigerant temperature at the discharge port 32*a* can be estimated with high accuracy by using the scroll compressor 10 including the first temperature sensor 15 and the second temperature sensor 25 described above.

Figure 7:
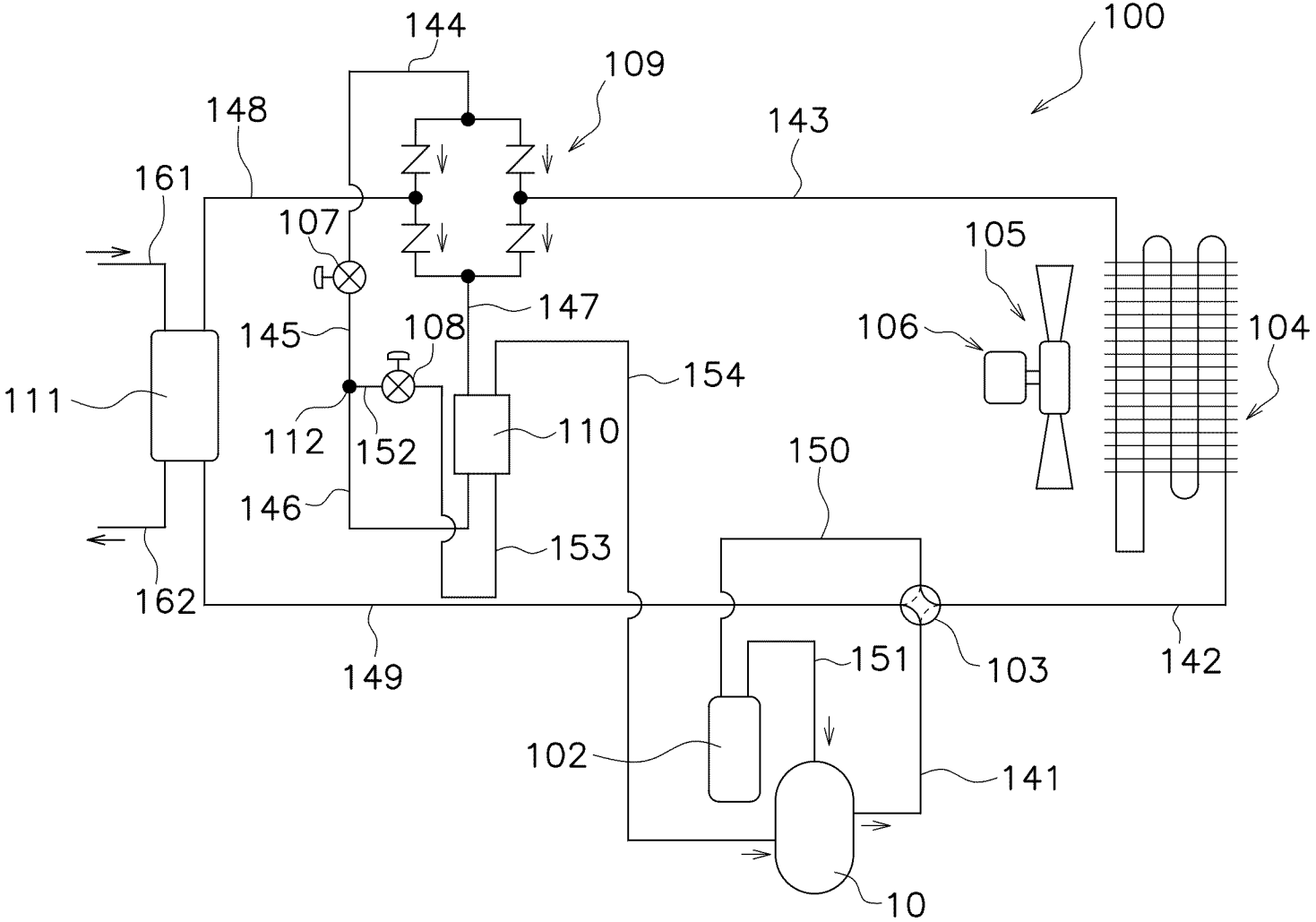
FIG. 7 is a diagram for describing an example of a configuration of a refrigeration cycle apparatus 100 including the compressor 10 according to the embodiment.

(4) Refrigeration Cycle Apparatus (4-1) Configuration of Refrigeration Cycle Apparatus FIG. 7 is a diagram for describing an example of a configuration of the refrigeration cycle apparatus 100 including the compressor 10 according to the present embodiment.

Here, the refrigeration cycle apparatus 100 is a water heating apparatus and/or cooling apparatus using a heat pump. Specifically, the refrigeration cycle apparatus 100 as a water heater or a water cooler supplies heated or cooled water. In addition, the refrigeration cycle apparatus 100 heats or cools a room by using the heated or cooled water as a medium.

As illustrated in FIG. 7, the refrigeration cycle apparatus 100 includes the scroll compressor 10, an accumulator 102 a four-way switching valve 103, an air heat exchanger 104, a check valve bridge 109, a first expansion mechanism 107, a second expansion mechanism (flow rate adjustment mechanism) 108, an economizer heat exchanger 110, and a water heat exchanger 111. Further, the refrigeration cycle apparatus 100 includes a fan 105 for passing air through the air heat exchanger 104, and a motor 106 that drives the fan 105. To be noted, the devices and a branching portion 112 are interconnected by pipes 141 to 154. In addition, each apparatus is controlled by the control apparatus 5.

To be noted, in the present embodiment, an "expansion mechanism" refers to one that can reduce the pressure of the refrigerant, and for example, an electronic expansion valve and a capillary tube correspond thereto. In addition, the opening degree of the expansion mechanism can be appropriately adjusted.

(4-2) Operation of Refrigeration Cycle Apparatus

In the refrigeration cycle apparatus 100, the control apparatus 5 performs the following control on each constituent device. To be noted, the control apparatus 5 is constituted by a microcomputer, a memory storing a program, and so forth.

(4-2-1) Circulation Control

Figure 8:
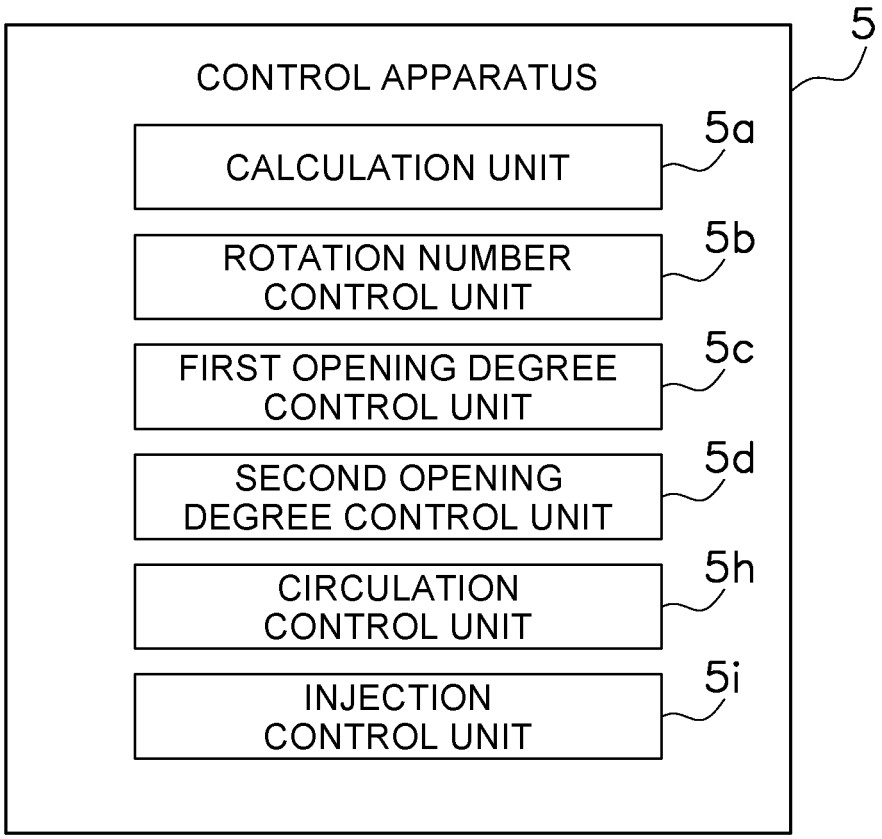
FIG. 8 is a schematic diagram for describing a configuration of a control apparatus 5 according to the embodiment.

The control apparatus 5 includes a circulation control unit 5*h* as illustrated in FIG. 8, and controls each constituent device of the refrigeration cycle apparatus 100 to perform control to circulate the refrigerant. Specifically, the refrigeration cycle apparatus 100 performs control to circulate the refrigerant when heating or cooling water.

For example, when water is heated, the gas refrigerant is delivered to the scroll compressor 10 under the control of the control apparatus 5. Then, the gas refrigerant is compressed by the scroll compressor 10. The compressed gas refrigerant is delivered to the water heat exchanger 111 that functions as a condenser. In the water heat exchanger 111, heat is exchanged between the gas refrigerant and water, and thus the refrigerant is liquified. Subsequently, the refrigerant is delivered to the first expansion mechanism 107. The first expansion mechanism 107 reduces the pressure of the refrigerant. Next, the refrigerant is delivered to the air heat exchanger 104 that functions as an evaporator. In the air heat exchanger 104, heat is exchanged between the refrigerant and air, and thus the refrigerant is evaporated. Then, the evaporated refrigerant is delivered to the scroll compressor 10 again. Thereafter, the refrigerant circulates among the constituent devices of the refrigeration cycle in a similar manner.

Then, at or after the timing when the circulation of the refrigerant is started, water is delivered from a water inlet pipe 161 to the water heat exchanger 111. At this time, a high-temperature refrigerant is flowing in the water heat exchanger 111. Therefore, in the water heat exchanger 111, water is heated by the refrigerant. The heated water is discharged through a water outlet pipe 162. The heated water is supplied in this manner.

To be noted, the water can be cooled by changing the flow of the refrigerant by switching the four-way switching valve 103. In this case, the water heat exchanger 111 functions as an evaporator of the refrigerant.

(4-2-2) Injection Control

The control apparatus 5 includes an injection control unit 5*i* as illustrated in FIG. 8, and performs injection control when performing the circulation control described above. In the refrigeration cycle apparatus 100 according to the present embodiment, the second expansion mechanism 108, the economizer heat exchanger 110, the branching portion 112, and the pipes 152 to 154 constitute a so-called injection circuit.

For example, in the case of heating water, the gas refrigerant compressed by the scroll compressor 10 is delivered under the control of the control apparatus 5 to the water heat exchanger 111 functioning as a condenser. In the water heat exchanger 111, heat is exchanged between the gas refrigerant and water, and thus the refrigerant is liquified. The liquified refrigerant is branched at the branching portion 112 and delivered to the second expansion mechanism 108.

Here, the second expansion mechanism 108 functions as a flow rate adjustment mechanism. Specifically, under the control of the control apparatus 5, the opening degree and the like of the second expansion mechanism 108 is adjusted. As a result of this, the flow rate of the branched refrigerant is adjusted. At this time, the pressure and temperature of the refrigerant is reduced as a result of a throttling-expansion effect of the second expansion mechanism 108. Then, the refrigerant is delivered from the second expansion mechanism 108 to the economizer heat exchanger 110.

The economizer heat exchanger 110 functions as a gasification mechanism. Specifically, in the economizer heat exchanger 110, heat is exchanged between the refrigerant flowing from the pipe 153 to the pipe 154 (refrigerant flowing in the injection circuit) and the refrigerant flowing from the pipe 147 to pipe 146 (refrigerant flowing in the main refrigeration cycle), and thus the refrigerant flowing from the pipe 153 to the pipe 154 (refrigerant flowing in the injection circuit) is gasified. Then, the gasified refrigerant is injected during compression by the scroll compressor 10. As a result of this, the discharge temperature of the gas refrigerant compressed by the scroll compressor 10 is adjusted so as not to be excessively high. To be noted, the "gasification" in the injection circuit used herein is satisfied as long as at least part of the liquid refrigerant is gasified (gas-rich state), and does not necessarily mean gasifying all of the liquid refrigerant.

(4-2-3) Rotation Number Control of Driving Motor

The control apparatus 5 includes a rotation number control unit 5*b* as illustrated in FIG. 8, and controls the number of rotations of the driving motor 70. Specifically, the rotation number control unit 5*b* controls the number of rotations of the driving motor 70 such that the temperature estimation value HTp of the refrigerant calculated by the calculation unit 5*a* described above reaches a discharge target temperature.

For example, in the case of supplying water of high temperature, the control apparatus 5 performs control such that the number of rotations of the driving motor 70 of the scroll compressor 10 increases. As a result of this, the amount of circulation of the refrigerant in the refrigeration cycle increases, and the amount of heat dissipation from the refrigerant in the water heat exchanger 111 per unit time increases. As a result of this, the temperature of the water with which heat is exchanged increases, and water of high temperature can be supplied. To be noted, the control apparatus 5 stops the rotation of the driving motor 70 when the temperature of the water is higher than a set temperature.

(4-2-4) Opening Degree Control of First Expansion Mechanism

The control apparatus 5 includes a first opening degree control unit 5*c* as illustrated in FIG. 8, and controls the opening degree of the first expansion mechanism 107. Specifically, the first opening degree control unit 5*c* controls the opening degree of the first expansion mechanism 107 on the basis of the temperature estimation value HTp of the refrigerant calculated by the calculation unit 5*a* described above.

For example, the control apparatus 5 performs control such that the opening degree of the first expansion mechanism 107 increases in the case where the estimation value of the discharge temperature of the refrigerant discharged from the scroll compressor 10 is higher than a target discharge temperature. As a result of this, the flow rate of the refrigerant passing through the air heat exchanger 104 increases, and the degree of superheating of the refrigerant sucked into the scroll compressor 10 decreases. Therefore, the discharge temperature of the refrigerant becomes closer to the target discharge temperature.

In addition, the control apparatus 5 may control the opening degree of the first expansion mechanism 107 such that the degree of subcooling of the refrigerant at an outlet portion of the water heat exchanger 111 or the degree of subcooling of the refrigerant at an outlet portion of the economizer heat exchanger 110 reaches a target degree of subcooling.

(4-2-5) Opening Degree Control of Second Expansion Mechanism

The control apparatus 5 includes a second opening degree control unit 5*d* as illustrated in FIG. 8, and controls the opening degree of the second expansion mechanism 108.

Figure 9:
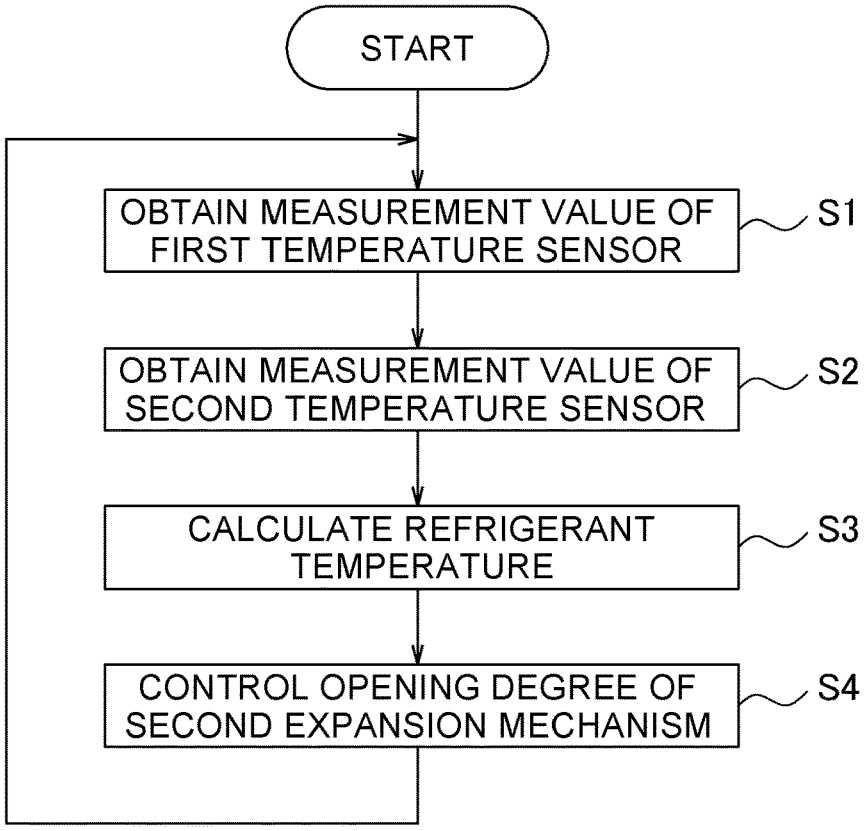
FIG. 9 is a flowchart for describing opening degree control of a second expansion mechanism according to the embodiment.

Specifically, the opening degree of the second expansion mechanism 108 is controlled by a procedure illustrated in FIG. 9. First, the calculation unit 5*a* of the control apparatus 5 obtains the measurement value Tp of the first temperature sensor 15 (S1). In addition, the calculation unit 5*a* obtains the measurement value Td of the second temperature sensor 25 (S2). Here, the timings of the step S1 and the step S2 may be revered or the same. Then, the calculation unit 5*a* calculates the temperature estimation value HTp of the refrigerant at the discharge port 32*a* of the scroll compression mechanism 50 from the measurement value Tp of the first temperature sensor 15 and the measurement value Td of the second temperature sensor 25 (S3). Next, the second opening degree control unit 5*d* of the control apparatus 5 controls the opening degree of the second expansion mechanism 108 on the basis of the temperature estimation value HTp of the refrigerant calculated by the calculation unit 5*a* described above (S4).

For example, the control apparatus 5 performs control such that the opening degree of the second expansion mechanism 108 increases in the case where the estimation value of the discharge temperature of the refrigerant discharged from the scroll compressor 10 is higher than the target discharge temperature. As a result of this, the flow rate of the refrigerant flowing into the injection circuit increases, and the temperature of the refrigerant sucked into the scroll compressor 10 is reduced. Therefore, the discharge temperature of the refrigerant becomes closer to the target discharge temperature.

(5) Features (5-1)

As described above, the scroll compressor 10 of the present embodiment includes the casing 20, the scroll compression mechanism 50, the discharge tube 24, the first temperature sensor 15, and the second temperature sensor 25.

Here, the first temperature sensor 15 includes the temperature sensing portion 15*a*. The temperature sensing portion 15*a* is disposed in the second refrigerant channel R2. The temperature sensing portion 15*a* is capable of directly measuring the temperature of the refrigerant (measurement value Tp). "Directly measure" means directly measuring the temperature of the refrigerant instead of measuring the temperature of a pipe in which the refrigerant flows or a part that receives heat transmission from the refrigerant. Therefore, temperature quickly following the change of the discharge temperature immediately after the discharge port 32*a* of the scroll compression mechanism 50 can be measured by using the first temperature sensor 15.

In addition, the second temperature sensor 25 measures the temperature of the surface of the discharge tube 24 (measurement value Td). Therefore, temperature reflecting an influence of the heat capacity of constituent members of the scroll compressor 10 can be measured by using the second temperature sensor 25.

Therefore, in the scroll compressor 10 of the present embodiment, by using the two temperature values measured by the first temperature sensor 15 and the second temperature sensor 25, the temperature of the refrigerant immediately after the discharge port 32*a* of the scroll compression mechanism 50 (temperature estimation value HTp) can be estimated with high accuracy. As a result, the scroll compressor 10 of high reliability can be disposed.

Here, additional description will be given on the effect of the scroll compressor 10 of the present embodiment. In the scroll compressor 10, constituent members therein may be damaged when the discharge temperature of the refrigerant becomes excessively high, and therefore control is performed such that the discharge temperature of the refrigerant does not exceed a predetermined value. Further, as a first method for performing the control described above, there is a method of measuring the temperature of the discharge tube 24 extending from the casing 20 of the scroll compressor 10 and estimating a value corrected in consideration of heat loss or the like as the discharge temperature. In addition, as a second method, there is a method of disposing a temperature sensor at the position of the discharge port 32*a* of the scroll compressor 10 where the temperature becomes the highest, and estimating the measurement value thereof as the discharge temperature.

In the case of the first method, delay or retardation of response to temperature change derived from the heat capacity of the casing 20 or the like of the scroll compressor 10, or temperature reduction derived from heat dissipation to the surroundings occurs. Here, the amount of temperature change greatly differs depending on the operation conditions. Therefore, in some cases, the temperature at the discharge port 32*a* of the scroll compressor 10 cannot be accurately estimated. As a result, in some cases, the discharge temperature exceeds an acceptable upper limit, and the scroll compressor 10 may be damaged. Alternatively, in some cases, an excessively large error is taken into consideration for ensuring reliability, thus the compressor is overdesigned, and the cost may increase. In addition, as a result of setting the upper limit of the discharge temperature to be low, in some cases, an operation allowable area of the compressor may become small, or the operation of the scroll compressor 10 may be inefficient. Further, in some cases, cooling is performed by liquid injection or the like such that the temperature at the discharge port 32*a* does not exceed the upper limit. However, in some cases, the timing of the cooling is delayed due to the delay in the response of temperature measurement, and superheating occurs or discharge wetting occurs due to subcooling. As a result, the reliability of the scroll compressor 10 may be degraded in some cases.

Meanwhile, using the second method to resolve the problems of the first method can be also considered. However, in the second method, a temperature sensor needs to be disposed inside the casing 20 of the scroll compressor 10. Therefore, attaching the temperature sensor is complicated, and the cost increases. In addition, due to a structure for attaching the temperature sensor near the discharge port 32*a*, leakage of refrigerant, loss of pressure, and the like sometimes occur inside the compressor. In addition, since the temperature sensor is exposed to a high-temperature high-pressure atmosphere, malfunction is likely to occur. Further, once malfunction occurs, a problem arises that, for example, the temperature sensor cannot be easily replaced.

The scroll compressor 10 according to the present embodiment includes the two temperature sensors, that is, the first temperature sensor 15 that is disposed in a refrigerant channel in the casing 20 and directly measures the temperature of the refrigerant and the second temperature sensor 25 that measures the surface temperature of the discharge tube 24, and therefore can calculate the discharge temperature of the refrigerant with high accuracy. As a result, the problems that arise in the first method and the second method described above can be avoided, and the scroll compressor 10 of high reliability can be disposed.

(5-2)

In addition, in the scroll compressor 10 according to the present embodiment, the first temperature sensor 15 is disposed to penetrate the casing, and is detachably attached to the casing 20 from the outside. Therefore, maintenance can be easily performed even if the first temperature sensor 15 is out of order. In addition, since a structure in which the first temperature sensor 15 can be easily replaced is employed, the durability does not need to be considered more than necessary. As a result, the production cost can be suppressed.

(5-3)

In addition, in the scroll compressor 10 according to the present embodiment, the temperature sensing portion 15*a* of the first temperature sensor 15 is thermally insulated from the casing 20. Therefore, the temperature of the refrigerant can be measured with high accuracy.

(5-4)

In addition, the scroll compressor 10 according to the present embodiment further includes the guide plate 65 that is disposed inside the casing 20 and reduces the channel cross-sectional area of the refrigerant channel. Here, since the guide plate 65 is disposed such that the channel cross-sectional area is reduced, the flow rate of the refrigerant in that space increases. Then, the first temperature sensor 15 measures the temperature in the space (second refrigerant channel R2) defined by the guide plate 65. Therefore, according to such a configuration, the temperature of the refrigerant of high flow rate is measured, and therefore the responsiveness can be improved.

(5-5)

In addition, in the scroll compressor 10 according to the present embodiment, the driving motor 70 is disposed to form the third refrigerant channel R3 in part of the space between the outer periphery of the driving motor 70 and the inner wall of the casing 20. In addition, the guide plate 65 is disposed so as to guide the refrigerant to the third refrigerant channel R3 between the outer periphery of the driving motor 70 and the inner wall of the casing 20. Therefore, the scroll compressor 10 can be manufactured in a small size. Specifically, according to the configuration described above, a core cut portion of the outer periphery of the driving motor 70 can be used as a channel. Therefore, no additional space needs to be provided, and thus reduction of the size and cost of the scroll compressor 10 can be realized.

To be noted, here, the guide plate 65 is disposed such that the refrigerant is concentrated in part (core cut portion of one pole portion) of the space between the outer periphery of the driving motor 70 and the inner wall of the casing 20. Therefore, other core cut portions can be used for oil return or the like.

(5-6)

In addition, in the scroll compressor 10 according to the present embodiment, among a region near the inner wall of the casing 20, the discharge tube 24 is disposed approximately on the opposite side to the region defined by the guide plate 65 in plan view. According to such a configuration, the second temperature sensor 25 can measure a temperature reflecting an influence that is not reflected in the first temperature sensor 15. In addition, the first temperature sensor 15 can measure a temperature not greatly reflecting an influence of the heat capacity of constituent members of the scroll compressor 10. Meanwhile, the second temperature sensor 25 can measure a temperature greatly reflecting the influence of the heat capacity of constituent members of the scroll compressor 10. Therefore, the temperature measurement value of the second temperature sensor 25 reflects an influence not reflected in the first temperature sensor 15.

(5-7)

In addition, in the scroll compressor 10 according to the present embodiment, the second temperature sensor 25 is disposed within the range where the length of a channel from the casing 20 is 1 m or less. According to such a configuration, influence of heat loss and heat capacity can be suppressed.

(5-8)

As described above, in the refrigeration cycle apparatus 100 according to the present embodiment, the water heat exchanger 111 and the air heat exchanger 104 can be respectively used as a condenser and an evaporator. In this case, the refrigeration cycle apparatus 100 has a refrigeration cycle in which the refrigerant flows in the order of the scroll compressor 10, the condenser (water heat exchanger 111), the first expansion mechanism 107, and the evaporator (air heat exchanger 104).

Here, the refrigeration cycle apparatus 100 further includes the calculation unit 5*a* that calculates the temperature of the refrigerant discharged from the scroll compression mechanism 50, by using the first temperature sensor 15 and the second temperature sensor 25.

Therefore, the refrigeration cycle apparatus 100 can estimate the refrigerant temperature immediately after the discharge port 32*a* of the scroll compression mechanism 50 with high accuracy.

(5-9)

In addition, the refrigeration cycle apparatus 100 according to the present embodiment further includes the rotation number control unit 5*b* that controls the number of rotations of the driving motor 70 on the basis of the temperature of the refrigerant calculated by the calculation unit 5*a*. According to such a configuration, the refrigeration cycle apparatus 100 of high reliability can be disposed.

For example, the pressure in a high-pressure state can be reduced by reducing the number of rotations of the driving motor 70 under the control of the rotation number control unit 5*b*. As a result of this, the discharge temperature can be lowered, and problems such as deterioration of oil and damage to mechanical parts can be avoided.

(5-10)

In addition, the refrigeration cycle apparatus 100 according to the present embodiment further includes the pipes 152 to 154 (injection pipes), the second expansion mechanism 108 (flow rate adjustment mechanism), and the second opening degree control unit 5*d*. Here, the pipes 152 to 154 are branched from a pipe extending from the water heat exchanger 111 (condenser) to the first expansion mechanism 107, and are connected to the scroll compressor 10. The second expansion mechanism 108 adjusts the flow rate of the refrigerant in the pipes 152 to 154. The second opening degree control unit 5*d* controls the opening degree of the second expansion mechanism 108 on the basis of the temperature of the refrigerant calculated by the calculation unit 5*a*. According to such a configuration, the refrigeration cycle apparatus 100 of high reliability can be disposed.

For example, by estimating the discharge temperature with high accuracy, occurrence of superheating, discharge wetting, or the like derived from response delay of temperature measurement can be avoided.

(5-11)

In addition, the refrigeration cycle apparatus 100 according to the present embodiment further includes the economizer heat exchanger 110 (gasification mechanism) that gasifies the liquid refrigerant flowing in the pipes 152 to 154. According to such a configuration, control can be performed with higher accuracy such that the discharge temperature of the refrigerant reaches a target value.

(5-12)

To be noted, the refrigeration cycle apparatus 100 according to the present embodiment is suitable for a use in which the temperature of the refrigerant discharged from the scroll compressor 10 needs to be high. Particularly, in the case of using R32 as the refrigerant, since the discharge temperature is high, the refrigeration cycle apparatus 100 according to the present embodiment is suitably used. For example, the refrigeration cycle apparatus 100 according to the present embodiment is suitably applied to a water-heating air-heating machine using a heat pump, as a substitute for a combustion heater.

(6) Modification Examples (6-1)

In the description above, the scroll compressor 10 and the control apparatus 5 have been described as separate apparatuses, but part or all of the functions of the control apparatus 5 may be incorporated in the scroll compressor 10. In other words, the scroll compressor 10 may have the function of estimating the temperature of the refrigerant at the discharge port 32*a*.

(6-2)

Although the second temperature sensor 25 has been described as the temperature sensor measuring the temperature of the surface of the discharge tube 24 in the description above, the second temperature sensor 25 is not limited thereto. Specifically, the second temperature sensor 25 may be disposed at a different position from the first temperature sensor 15 and measure the temperature of one of the surface of the discharge tube 24, an inner space of the discharge tube 24, and the surface of the casing 20. Even if the second temperature sensor 25 is disposed in these positions, the temperature of the refrigerant at the discharge port 32*a* can be estimated with high accuracy by using the measurement value of the first temperature sensor 15 in combination.

(6-3)

Although the refrigeration cycle apparatus 100 has been described as heating or cooling water in the description above, the refrigeration cycle apparatus 100 is not limited thereto. For example, the refrigeration cycle apparatus 100 may heat and cool a brine as a fluid different from water, or heat and cool a room as a direct-expansion air conditioner by using an indoor unit in which the water heat exchanger is replaced by an air heat exchanger.

(6-4)

Although the description above has been given by describing the scroll compressor 10, the compressor is not limited thereto. The compressor according to the present embodiment may be a different compressor such as a rotary compressor.

OTHER EMBODIMENTS

Embodiments have been described above, and it should be understood that the embodiments and details can be modified in various ways without departing from the gist and range of the scope of claims.

In other words, the present disclosure is not limited to the original embodiments described above. The present disclosure can be materialized by modifying the constituent elements within the range not departing from the gist thereof at the stage of implementation. In addition, the present disclosure can make up various disclosures by appropriately combining a plurality of constituent elements disclosed in the embodiments described above. For example, some constituent elements may be eliminated from all the constituent elements described in the embodiments. Further, constituent elements may be appropriately combined with a different embodiment.

What is claimed is:

1. A compressor comprising:

a casing;

a compression mechanism disposed inside the casing, the compression mechanism compressing a sucked refrigerant, and discharging the compressed refrigerant to a refrigerant channel formed in an inner space of the casing;

an oil reservoir space defined in a lower portion of the casing below the compression mechanism;

a discharge tube through which the compressed refrigerant flows from the inner space of the casing to an outside;

a first temperature sensor including a temperature sensing portion disposed in the refrigerant channel on a discharge side of the compression mechanism, the temperature sensing portion directly measuring a temperature of the refrigerant; and a second temperature sensor disposed on a different portion of the compressor from the first temperature sensor and on a discharge side of the compression mechanism, the second temperature sensor being disposed on a surface of the discharge tube, in an inner space of the discharge tube, or on a surface of the casing at a position above the oil reservoir space.

2. The compressor according to claim 1, wherein the second temperature sensor is disposed on the surface of the discharge tube.

3. The compressor according to claim 1, wherein the first temperature sensor is disposed to penetrate the casing, and the first temperature sensor is detachably attached to the casing from the outside.

4. The compressor according to claim 1, wherein the temperature sensing portion of the first temperature sensor is thermally insulated from the casing.

5. The compressor according to claim 1, further comprising:

a guide plate disposed inside the casing, the guide plate reducing a channel cross-sectional area of the refrigerant channel, the first temperature sensor measuring a temperature of a space defined by the guide plate.

6. The compressor according to claim 5, further comprising:

a motor disposed below the compression mechanism inside the casing, the motor driving the compression mechanism, the motor being disposed such that the refrigerant channel is formed in part of a space between an outer periphery of the motor and an inner wall of the casing, and the guide plate being disposed to guide the refrigerant to the refrigerant channel between the outer periphery of the motor and the inner wall of the casing.

7. The compressor according to claim 5, wherein in a region near the inner wall of the casing, the discharge tube is disposed on an opposite side to a region defined by the guide plate, as seen in a plan view.

8. The compressor according to claim 1, wherein the second temperature sensor is disposed within a range where a channel length from the casing is 1 m or less.

9. A refrigeration cycle apparatus including the compressor of claim 1, the refrigeration cycle apparatus further comprising:

a refrigeration cycle including a condenser, an expansion mechanism, and an evaporator;

a controller including a microcomputer; and refrigerant flowing in order through the compressor, the condenser, the expansion mechanism and the evaporator, the controller being configured to calculate a temperature of a refrigerant discharged from the compression mechanism based on a first measurement value of the first temperature sensor and a second measurement value of the second temperature sensor.

10. The refrigeration cycle apparatus according to claim 9, wherein the compressor includes a motor disposed below the compression mechanism inside the casing, the motor driving the compression mechanism, and the controller is further configured to control, based on the temperature of refrigerant that was calculated a rotational speed of the motor in order to adjust a discharge temperature.

11. The refrigeration cycle apparatus according to claim 9, further comprising:

an injection pipe branched from part of a pipe extending from the condenser to the expansion mechanism, the injection pipe connecting to the compressor; and an expansion valve configured to adjust a flow rate of the refrigerant in the injection pipe, the controller being configured to control an opening degree of the expansion valve based on the temperature that was calculated.

12. The refrigeration cycle apparatus according to claim 11, further comprising:

a heat exchanger configured to gasify a liquid refrigerant flowing in the injection pipe.

13. The compressor according to claim 2, wherein the first temperature sensor is disposed to penetrate the casing, and the first temperature sensor is detachably attached to the casing from the outside.

14. The compressor according to claim 2, wherein the temperature sensing portion of the first temperature sensor is thermally insulated from the casing.

15. The compressor according to claim 2, further comprising:

a guide plate disposed inside the casing, the guide plate reducing a channel cross-sectional area of the refrigerant channel, the first temperature sensor measuring a temperature of a space defined by the guide plate.

16. The compressor according to claim 3, wherein the temperature sensing portion of the first temperature sensor is thermally insulated from the casing.

17. The compressor according to claim 3, further comprising:

a guide plate disposed inside the casing, the guide plate reducing a channel cross- sectional area of the refrigerant channel, the first temperature sensor measuring a temperature of a space defined by the guide plate.

18. The compressor according to claim 4, further comprising:

a guide plate disposed inside the casing, the guide plate reducing a channel cross- sectional area of the refrigerant channel, the first temperature sensor measuring a temperature of a space defined by the guide plate.

19. The compressor according to claim 6, wherein in a region near the inner wall of the casing, the discharge tube is disposed on an opposite side to a region defined by the guide plate, as seen in a plan view.

20. The refrigeration cycle apparatus according to claim 10, further comprising:

an injection pipe branched from part of a pipe extending from the condenser to the expansion mechanism, the injection pipe connecting to the compressor; and an expansion valve configured to adjust a flow rate of the refrigerant in the injection pipe, the controller being configured to control an opening degree of the expansion valve based on the temperature that was calculated.

* * * * *